US005302478A

United States Patent [19]

Springett

[11] Patent Number: 5,302,478

[45] Date of Patent: Apr. 12, 1994

[54] IONOGRAPHIC IMAGING MEMBERS AND METHODS FOR MAKING AND USING SAME

[75] Inventor: Brian E. Springett, Rochester, N.Y.

[73] Assignee: Xerox Corporation, Stamford, Conn.

[21] Appl. No.: 575,392

[22] Filed: Aug. 30, 1990

[51] Int. Cl.[5] ..... G03G 17/00

[52] U.S. Cl. ..... 430/53; 430/66; 430/128

[58] Field of Search ..... 430/53, 66, 67, 128

[56] References Cited

U.S. PATENT DOCUMENTS 3,614,544 10/1971 Mosebach et al. ..... 317/230
3,874,942 4/1975 Negishi et al. ..... 430/56
4,021,668 5/1977 Pfeifer et al. ..... 250/315 A
4,057,723 11/1977 Sarid et al. ..... 250/326
4,729,937 3/1988 Yamazaki ..... 430/65
4,737,429 4/1988 Mort et al. ..... 430/58
4,762,761 8/1988 Mitani ..... 430/65

*Primary Examiner*—Steve Rosasco
*Attorney, Agent, or Firm*—Oliff & Berridge

[57] ABSTRACT

Ionographic imaging members include an electrically conductive layer and a dielectric layer which contains boron nitride. The dielectric layer may contain boron nitride alone or boron nitride dispersed in a binder. Methods are provided for preparing and using such imaging members.

16 Claims, 1 Drawing Sheet

IONOGRAPHIC IMAGING MEMBERS AND METHODS FOR MAKING AND USING SAME

BACKGROUND OF THE INVENTION

This invention relates to ionographic imaging members and, more particularly to ionographic imaging members comprising an electrically conductive layer and a dielectric layer.

In ionography, a latent image is created by writing on the surf ace of the imaging member with an ion head. The imaging member is preferably electrically insulating so that the charge applied by the ion head does not disappear prior to development. Therefore, ionographic receivers possess negligible, if any, photosensitivity. The absence of photosensitivity provides considerable advantages in ionographic applications. For example, the electroreceptor enclosure does not have to be completely impermeable to light and radiant fusing can be used without having to shield the receptor from stray radiation. Also, the level of dark decay in these ionographic receivers is characteristically low, thus providing a constant voltage profile on the receiver surface over extended time periods.

Electroreceptors are useful in ionographic imaging and printing systems such as those commercially available as the Xerox Corporation 4060(tm) and the Xerox Corporation 4075(tm), which utilize an electrically resistive dielectric image receiver, i.e., an electroreceptor. In one simple form of the systems, latent images are formed by depositing ions in a prescribed pattern onto the electroreceptor surface with a linear array of ion emitting devices or ion heads, creating a latent electrostatic image. Electrostatic images of sufficient electric field and potential are created and retained at the surface of the electroreceptor. The latent image may be formed by applying a surface charge density on the receiver surface of from about 10 to about 100 nanoCoulombs per square centimeter. These electrostatic patterns are suitable for development with toner and developer compositions.

To develop latent images, charged toner particles are passed over these latent images, and the toner particles remain where a charge has previously been deposited. This developed image is then transferred to a substrate such as paper, and permanently affixed thereto.

An alternative developing method is liquid immersion development. In a liquid development process, a charged imaging surface is passed through a liquid medium which includes toner particles dispersed in a liquid carrier. Liquid development processes typically use a low molecular weight hydrocarbon as the liquid carrier.

A typical ionographic charge receiver, schematically shown in FIGURE 1, includes a conductive substrate 11 and a dielectric layer 12 positioned over the substrate 11. The substrate 11 depicted in FIGURE 1 is in the shape of an endless seamless belt.

It is important that the dielectric layer act as a loss-less capacitor, since the purpose of the dielectric layer is to store electric charge on its surface, minimizing the amount of charge that leaks therefrom. Any such leakage makes it necessary to provide greater amounts of charge initially. Similarly, it is preferable to provide a dielectric layer which does not permit charge to migrate into the bulk of the dielectric layer, which results in instabilities in capacitance and degrades image formation.

Prior art dielectric layers sometimes become degraded during use so that their loss-less character is impaired. Similarly, degradation can increase the possibility of charge migration in the dielectric layer. Thus, it is important that the dielectric layer be resistant to its operating environment, in particular, resistant to degradation brought about by the powerful oxidants and U.V. light emitted by corona charging devices which are typically used to form charge images. The dielectric layer should also have properties which are not substantially altered by changes in the temperature or humidity of its operating environment. Since typical toning and cleaning operations can be quite abrasive, it is important that the dielectric layer also be able to withstand significant abrasion, scratching and other physical wear related contacts.

SUMMARY OF THE INVENTION

It is an object of the present invention to provide ionographic imaging members which can withstand long-term employment in an imaging system.

It is another object of the present invention to provide ionographic imaging members having a uniform dielectric layer of high dielectric strength, low conductivity and high charge acceptance, which can be coated to thicknesses of up to 100 micrometers, preferably up to 250 micrometers.

It is still another object of the present invention to provide ionographic imaging members that have high abrasion resistance, high durability, and low wear rate, which are relatively impervious to environmental oxidants, which are non-toxic and which have low coefficients of friction.

It is still another object of the present invention to provide ionographic imaging members that can be easily and inexpensively fabricated.

These and other objects are accomplished according to the present invention by providing ionographic imaging members comprising an electrically conductive layer and a dielectric layer comprising boron nitride, and processes for forming such imaging members. The dielectric layer may consist essentially of boron nitride or may comprise boron nitride dispersed in a binder.

The present invention also provides ionographic imaging processes which use an ionographic imaging member comprising an electrically conductive layer and a dielectric layer comprising boron nitride.

BRIEF DESCRIPTION OF THE DRAWING

The invention may be more fully understood with reference to FIGURE 1, which is a schematic illustration of an ionographic imaging member.

DETAILED DESCRIPTION OF PREFERRED EMBODIMENTS

Figure 1:
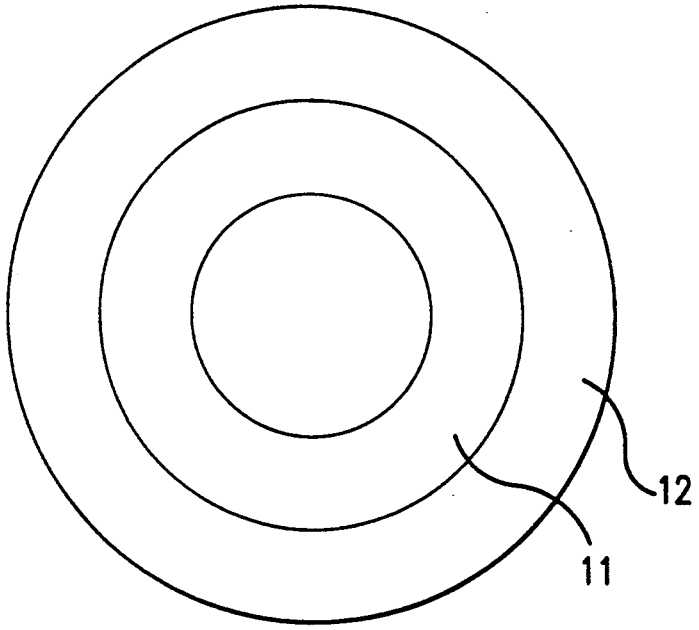

According to preferred embodiments of the present invention, an ionographic imaging member comprises a substrate which has an electrically conductive surface, and a dielectric layer comprising boron nitride. The dielectric layer may consist essentially of boron nitride or may comprise and/or consist essentially of boron nitride dispersed in a binder.

Ionographic imaging members in accordance with the present invention provide numerous advantages, for example, they charge as loss-less capacitors, they are substantially inert to corona effluents, they are very resistant to corrosion, they exhibit high dielectric strength, and they have a dielectric constant similar to imaging members which employ selenium alloys or silicon.

Another significant advantage in accordance with preferred embodiments of the present invention is obtained with the use of a boron nitride film (consisting essentially of boron nitride) or with a boron nitride-binder layer in which the binder is inorganic. Such dielectric layers are entirely inorganic. As a result, it is possible to use liquid ink processes without the need to protect the surface of the dielectric layer. With dielectric layers formed of organics or organic-pigment matrices, it is generally necessary to protect the surface thereof. For example, dielectric layers formed of many organic materials are permeable to hydrocarbons used as liquid carriers in a liquid immersion development process. As a result, the dielectric layer can swell, leading to excessive or uneven wear, or to lateral charge migration, thereby giving rise to blumed images. Swelling can also lead to charge migration into the bulk of the dielectric layer.

Specific electric properties such as dielectric constant c may be engineered directly into the imaging member through adjustment of the boron nitride concentration in the binder resin (if employed), adjustment of the dielectric layer thickness, or both. The dielectric constant of imaging members according to this invention may be as low as 2. Dielectric constants of from 2 to 100 are acceptable for dielectric receivers according to the present invention.

Particularly preferred substrates for a rigid drum-shaped imaging member in accordance with the present invention comprise conductive aluminum which has been treated by an anodization or other oxidation method at the surface adjacent the dielectric layer. The discussion below gives more details concerning suitable substrates. Preferred substrates for a flexible belt-shaped imaging member comprise electroformed nickel.

Ionographic imaging members in accordance with the present invention are preferably prepared by first providing a substrate having an electrically conductive surface. The substrate can be formed of an electrically conductive material, or it may comprise a non-conductive material with an electrically conductive coating on a surface thereof. When the substrate is formed of an electrically conductive material, there may or may not be an electrically conductive coating provided over the substrate. In instances where the substrate is formed of a non-conductive material, an electrically conductive coating must be applied over the substrate in order to provide for electrical grounding.

The substrate may be opaque or substantially transparent, and may comprise any of numerous suitable materials having required mechanical and/or electrical properties. The substrate is preferably flexible and may have any of a number of different configurations such as, for example, a sheet, a scroll, an endless flexible belt, and the like. Preferably, the substrate is in the form of an endless flexible belt. Substrates in the form of a rigid cylinder are also highly desirable.

Suitable materials out of which a non-conductive substrate can be formed include any suitable polymer, for example, polycarbonates (e.g., Makrolon 5705, available from Bayer Chemical Co., Merlon M39, available from Mobay Chemical Co., Lexan 145, available from General Electric Co.), polysulfones (e.g., P-3500, available from Union Carbide Corp.), polyesters (e.g., PE-100 and PE-200, available from Goodyear Tire and Rubber Co.), cellulosic resins, polyarylates, alkyds, acrylics, styrene-butadiene copolymers, polyarylsulfones, polybutylenes, polyether sulfones, polyphenylenesulfides, polyurethanes, polyamides, polyimides (e.g., Kapton, available for E.I. du Pont de Nemours & Co.), epoxies, poly(amide-imide) (e.g., A1830, available from Amoco Chemical Corp.), copolyesters (e.g., Kodar Capolyester PETG 6763 available from Eastman Kodak Co.), polyethersulfones, polyetherimide (e.g., Ultem available from General Electric Co.), polyether sulfone, polyvinylidine fluoride (e.g., Kynar 202® available from Pennwalt Corp.) polyvinyl fluoride (e.g., Tedlar, available from E.I. du Pont de Nemours & Co.), polyarlyethers, and the like, and mixtures thereof. Polycarbonate polymers may be made., for example, from 2,2-bis(4-hydroxyphenol)propane, 4,4'-dihydroxydiphenyl-1,1-ethane, 4,4'-dihydroxy-diphenyl-1,1-isobutane, 4,4'-dihydroxy-diphenyl-4,4-heptane, 4,4'-dihydroxy-diphenyl-2,2-hexane, 4,4'-dihydroxy-triphenyl-2,2,2-ethane, 4,4'-dihydroxy-diphenyl-1,1-cyclohexane, 4,4'-dihydroxy-diphenyl-β-β-decahydronaphthalene, cyclopentane derivatives of 4,4'-dihydroxy-diphenyl-β-β-decahydronaphthalene, 4,4'-dihydroxy-diphenyl-sulfone, and the like. Particularly preferred materials for use in forming a non-conductive substrate include commercially available biaxially oriented polyesters, e.g., Mylar, available from E.I. Du Pont de Nemours & Co., Melinex, available from ICI Americas, Inc., and Hostaphan, available from American Hoechst Corporation. Amorphous polymers such as polycarbonate polymers from diphenyl-1,1-cyclohexane and phosgene having a molecular weight of from about 25,000 to about 60,000 are particularly preferred materials out of which a non-conductive substrate may be formed for electroreceptors for some applications. Such a substrate is mechanically strong and resists crazing and cracking when exposed to solvents employed in subsequently applied coating(s) during the production of ionographic imaging members.

Suitable electrically conductive materials out of which a conductive substrate may be formed include, f or example, metal flakes, powders or fibers of materials such as metal oxides, sulfides, silicides, quaternary ammonium salt compositions, conductive polymers such as polyacetylenes or their pyrolysis and molecular doped products, charge transfer complexes, polyphenylsilane and molecular doped products from polyphenylsilane. A preferred conductive substrate according to the present invention comprises an aluminum drum of a thickness of about 1 inch and an outer diameter of from about 4 to about 6 inches. A particularly preferred substrate in accordance with the present invention comprises conductive aluminum which has been treated by an anodization method or the like to provide an oxidized outer layer.

The preferred thickness of the substrate depends on numerous factors, including desired mechanical performance and economic considerations. The thickness of the substrate is typically within the range of from about 65 micrometers to about 150 micrometers, preferably from about 75 micrometers to about 125 micrometers for optimum flexibility and minimum induced surface bending stress when cycled around rollers of 20 millimeters diameter or less. The substrate for a flexible belt may be of substantial thickness, for example, over 200 micrometers, or of relatively small thickness, for example, less than 50 micrometers, provided there are not adverse effects on the final device. Flexible electroformed nickel belts having a thickness of between about 50 micrometers and about 200 micrometers, which have been treated to provide an oxidized outer layer, are especially preferred as substrates for flexible belt-shaped imaging members.

The surf ace of the substrate to which a layer is to be applied is preferably cleaned to promote greater adhesion of such applied layer. Cleaning may be effected by exposing the surface of the substrate layer to plasma discharge, ion bombardment and the like. Corona treatment of the surface of the substrate may be employed to provide better adhesion to the substrate.

Suitable metals for the electrically conductive coating (if one is employed) include aluminum, zirconium, niobium, tantalum, vanadium, hafnium, titanium, nickel, stainless steel, chromium, tungsten, gold, carbon black, graphite, molybdenum, copper and the like, and mixtures and alloys thereof, such as brass. Nickel and aluminum conductive coatings are particularly preferred. The conductive coating may comprise conductive particles dispersed in a film forming binder. In such a conductive coating, the concentration of conductive particles must be sufficient to provide the electrical conductivity desired. A typical conductive particle loading is from about 10% to about 35% by volume based on the total volume of the conductive layer. Suitable conductive particles include carbon black, metal powders (such as the metals described above), ionic organic conductive particles, conductive inorganic particles, $SnO_2$ doped with antimony or indium, conductive zinc oxide, and the like. The conductive coating is preferably applied as a sprayable composition including one or more suitable type of conductive particle, for example, finely divided aluminum, titanium, nickel, silver, copper, chromium, brass, gold, stainless steel, carbon black, graphite or the like in the form of a pigment, fiber, etc. dispersed in a film-forming polymer binder such as one or more of the polymers described herein as being suitable for use as the non-conductive layer. Other examples of suitable conductive layers are combinations of materials such as conductive indium tin oxide.

Regardless of the technique employed to form a conductive metal layer, in many instances, a thin layer of metal oxide forms on the surface of the substrate upon exposure to air and may be present between the substrate and the dielectric layer.

In instances where an electrically conductive coating is applied over the substrate, it may be applied by any suitable technique, preferably by vacuum deposition. Alternatively, the conductive coating may be applied by spray coating, dip coating, brush coating, powder coating or f low coating, or the like, or may be molded. The conductive coating may be applied as a primer, preferably by a brush coating technique.

The thickness of any conductive coating applied over the substrate is within a substantially wide range, suitable thicknesses depending on the desired use of the final device. Satisfactory thicknesses for the conductive coating are generally within the range of from about 1 micrometer to about 20 micrometers. When a very flexible ionographic imaging device is desired, the thickness of the conductive coating on a polymeric substrate is preferably in the range of from about 0.5 micrometer to about 5 micrometers. A conductive coating that is too thick may adversely affect belt flexibility and a conductive coating that is unduly thin may have unsatisfactory uniformity of conductivity. For ionographic drums, conductive coating thicknesses are preferably from about 0.5 micrometer to about 25 micrometers, most preferably from about 0.5 micrometer to about 2 micrometers.

The dielectric layer may consist essentially of a film of boron nitride or may comprise and/or consist essentially of a layer of boron nitride dispersed in a binder.

A preferred technique for depositing a dielectric layer consisting essentially of a film of boron nitride is plasma deposition. In a particularly preferred plasma deposition technique, borane ($BH_3$) and ammonia ($NH_3$) are mixed in stoichiometric amounts in a deposition chamber. The borane and ammonia are heated under pressure to improve compatibility. Sufficient voltage and current, either d.c. or a.c., are supplied between two electrodes in a partially evacuated deposition chamber to disintegrate the compounds and form a plasma. One of the electrodes comprises a conductive substrate on which the deposition occurs. The compounds to be disintegrated are supplied to the deposition chamber at a relatively constant rate by means of a regulated flow control system. Preferably, the conductive substrate on which the boron nitride dielectric layer is formed is rotated at a steady rate during the deposition process, the rate being from about 0.2 to about 10 revolutions per minute. The deposition apparatus also contains a means for maintaining the temperature of the conducting substrate in the range of from about 150° C. to about 450° C. A more detailed description of a suitable plasma deposition process for use in the present invention is discussed in U.S. Pat. No. 4,737,429, the entirety of which is incorporated herein by reference. Boron and nitrogen deposit stoichiometrically from the plasma onto a deposition surface in the deposition chamber to form an amorphous boron nitride film, which incorporates some hydrogen into the structure.

Alternatively, a film of boron nitride may be plasma deposited using diborane ($B_2H_6$) and nitrogen gas ($N_2$) by a deposition process similar to the one discussed above.

A boron nitride film formed by plasma deposition provides very advantageous low porosity (a material density of from about 98% to about 100% of the natural boron nitride material density may be achieved) and very advantageous uniformity. Preferred thicknesses of boron nitride films formed by vapor plasma deposition are generally greater than 10 micrometers, more preferably from about 25 to about 100 micrometers, most preferably about 50 micrometers. The rate of deposition of boron nitride can be varied by varying the potential between the electrodes.

Alternatively, the boron nitride dielectric layer may comprise a layer of boron nitride dispersed in a nonconductive binder. Suitable binder materials include, for example, alumina, magnesium silicate, aluminum phosphate, polyesters, polycarbonates, polyurethanes, polyethers, polyethersulphone and the like. Preferred binder materials include high-temperature inorganic bonding phase materials. The most preferred binders are alumina, magnesium silicate, and aluminum phosphate.

The concentration of boron nitride in the dielectric layer is generally from about 50% to about 95%, preferably from about 75% to about 95%, based on the total weight of the dielectric layer. When alumina is used as the binder, the boron nitride content is preferably from about 75% to about 85% by weight. When magnesium silicate is used as the binder, the boron nitride content is preferably from about 80% to about 92% by weight. When aluminum phosphate is used as the binder, the boron nitride content is preferably from about 65% to about 75% by weight.

Suitable techniques for applying a dielectric layer of boron nitride in a binder material include, for example, spray coating, brush coating, powder coating, flow coating and dip coating. Of these, the most preferred techniques are spray coating, brush coating and dip coating.

When applying boron nitride-binder material dielectric layers by spray coating, brush coating or dip coating, the boron nitride and binder are preferably mixed with an appropriate aqueous solvent. Suitable compositions for use in such application techniques are available under the tradename Combat, available from Sohio Engineered Metals Co. To achieve relatively thick dielectric layers, a layer may be applied and then air dried, e.g., for 20–30 minutes, and the process repeated an appropriate number of times. After application of a suitable number of layers, the layers are cured to remove solvent by air drying for, e.g., 2–6 hours, and then subjected to a temperature of, e.g., about 200° F. for about 4 hours. Further heat treatment (preferably at temperatures greater than 800° F. and up to as high as 1500° F. or higher) can be employed to increase the hardness of the applied layer.

The technique of dip coating offers an additional advantage, in that distilled water may be employed as the solvent, thus avoiding environmental concerns otherwise faced when using other solvents.

Dielectric layers including boron nitride and binder material may be formed with thicknesses of up to about 250 micrometers or more. In general, suitable thicknesses are within the range of from about 10 micrometers to about 200 micrometers to provide desired dielectric properties. Thicknesses in the range of from about 20 micrometers to about 100 micrometers are more preferred.

Where the dielectric layer is to be used in connection with liquid developers, it is preferable to heat treat the dielectric layer after it has been formed to reduce the porosity such that the material density is between about 98% and 100% of the natural material density. Boron nitride films formed by plasma deposition are of such low porosity that such treatment may be unnecessary.

Adhesive layers may be provided, as necessary, between any of the layers in the ionographic charge receivers in accordance with the present invention to ensure adhesion of any adjacent layers. Alternatively or in addition, adhesive material may be incorporated into one or both of the layers to be adhered. Such optional adhesive layers preferably have thicknesses between about 0.001 micrometer and about 0.2 micrometer. Such adhesive layers may be applied by dissolving adhesive material in an appropriate solvent, applying by hand, spraying, dip coating, drawbar coating, gravure coating, silk screening, air knife coating, vacuum deposition, chemical treatment, roll coating, wire wound rod coating, and the like, and drying to remove the solvent. When applying adhesive by solvent coating, the substrate, conductive coating (if present) and any other layer are preferably isolated to prevent evaporation of solvent from interacting with such layers.

Suitable adhesives include, for example, film-forming polymers, such as polyester, du Pont 49,000 (available from E.I. du Pont de Nemours & Co.), Vitel PE-100 (available from Goodyear Rubber and Tire Co.), polyvinylbutyral, polyvinylpyrrolidone, polyurethane, polymethyl methacrylate, and the like.

A preferred technique for manufacturing an ionographic charge receiver according to this invention is by applying the material used to form the substrate on a mandrel. When such a technique is employed, it may be preferable to add a release agent to the composition out of which the substrate is formed to facilitate removal of the substrate from the mandrel. Typical release materials include, for example, release agents such as silicones, fluoropolymers including fluorocarbons, hydrocarbons, soaps, detergents, surfactants (e.g., Silwet L-7500, Silwet L-7602, available from Union Carbide Corporation, and GAFAC RA600 available from GAF Corporation) and the like. Generally, the amount of release material added is less than about 10 percent based on the total weight of the composition. The substrate may be removed from the mandrel once it is formed, or after any or all additional layers have been applied over the substrate.

The ionographic imaging members in accordance with the present invention are preferably packaged in such a way as to facilitate shipment and/or commercial sale of the imaging members. For example, one or more ionographic imaging member may be partially or completely enclosed in any suitable packaging material, e.g., paper products and/or plastic products, and the like, optionally together with cushioning materials to reduce the likelihood of the occurrence of damage to the imaging members.

The ionographic imaging members may also be shipped after having been treated with a lubricant useful in cleaning the outer surface during the cyclic imaging process. Materials such as finely divided metal oxides, e.g. silica or $SnO_2$, stearates, e.g. zinc or magnesium stearates, and the like may be carried on the surface of the packaged device. The application method may range from simple dusting by any of various convenient techniques to sprinkling the material on the surface prior to wrapping in a protective wrapper.

It may also be preferable to include a cleaning blade in a separate compartment in the shipping package.

Ionographic imaging members in accordance with the present invention have been described in connection with preferred embodiments. It will be appreciated by those skilled in the art that additions, modifications, substitutions and deletions not specifically described may be made without departing f rom the spirit and scope of the invention defined in the appended claims.

What is claimed is:

1. An ionographic imaging member comprising a conductive layer and a dielectric layer comprising boron nitride dispersed in non-conductive binder, wherein substantially all electric charge is stored on a surface of said dielectric layer, said imaging member possessing no more than negligible photosensitivity.

2. An ionographic imaging member as recited in claim 1, wherein said dielectric layer has a thickness of about 10 to about 100 micrometers.

3. An ionographic imaging member as recited in claim 1, wherein said imaging member comprises an endless belt.

4. An ionographic imaging member as recited in claim 1, wherein said binder comprises at least one member selected from the group consisting of alumina, magnesium silicate, and aluminum phosphate.

5. An ionographic imaging member as recited in claim 4, wherein said binder comprises alumina and said boron nitride comprises up to about 85% by weight of said dielectric layer.

6. An ionographic imaging member as recited in claim 4, wherein said binder comprises magnesium silicate and said boron nitride comprises up to about 92% by weight of said dielectric layer.

7. An ionographic imaging member as recited in claim 4, wherein said binder comprises aluminum phosphate and said boron nitride comprises up to about 75% by weight of said dielectric layer.

8. An ionographic imaging member as recited in claim 1, further comprising a lubricant on an outer surface thereof.

9. An ionographic imaging member comprising a conductive layer and a dielectric layer comprising boron nitride applied over said conductive layer by a plasma deposition method, said dielectric layer having a thickness of greater than 10 μm, wherein substantially all electric charge is stored on a surface of said dielectric layer, said imaging member possessing no more than negligible photosensitivity.

10. An ionographic imaging member as recited in claim 9, wherein said dielectric layer has a thickness of from about 20 micrometers to about 100 micrometers.

11. An ionographic imaging member as recited in claim 9, wherein said dielectric layer has a thickness of about 50 micrometers.

12. An ionographic imaging member as recited in claim 9, wherein said dielectric layer has a density of from about 98% to about 100% of the density of naturally occurring boron nitride.

13. An ionographic imaging member as recited in claim 9, wherein said conductive layer comprises aluminum.

14. An ionographic imaging member as recited in claim 9, wherein said imaging member comprises an endless belt.

15. An ionographic imaging member as recited in claim 9, further comprising a lubricant on an outer surface thereof.

16. An ionographic imaging member consisting essentially of a conductive layer and a dielectric layer comprising boron nitride enclosed in packaging material, wherein substantially all electric charge can be stored on a surface of said dielectric layer, said imaging member possessing no more than negligible photosensitivity.

* * * * *